US007432871B2

(12) United States Patent
Milroy et al.

(10) Patent No.: US 7,432,871 B2
(45) Date of Patent: Oct. 7, 2008

(54) TRUE-TIME-DELAY FEED NETWORK FOR CTS ARRAY

(75) Inventors: William W. Milroy, Torrance, CA (US); Stuart B. Coppedge, Manhattan Beach, CA (US); Alec Ekmekji, Los Angeles, CA (US); Shahrokh Hashemi-Yeganeh, Rancho Palos Verdes, CA (US); Steven G. Buczek, Brea, CA (US)

(73) Assignee: Raytheon Company, Waltham, MA (US)

( * ) Notice: Subject to any disclaimer, the term of this patent is extended or adjusted under 35 U.S.C. 154(b) by 323 days.

(21) Appl. No.: 11/075,106

(22) Filed: Mar. 8, 2005

(65) Prior Publication Data

US 2006/0202899 A1 Sep. 14, 2006

(51) Int. Cl.
*H01Q 13/00* (2006.01)
*H01Q 13/10* (2006.01)

(52) U.S. Cl. ..... 343/776; 343/771; 343/785

(58) Field of Classification Search ..... 343/767, 343/770, 772, 776, 785, 786, 771
See application file for complete search history.

(56) References Cited

U.S. PATENT DOCUMENTS

| | | | | |
|---|---|---|---|---|
| 2,628,311 | A | 2/1953 | Lindenblad | |
| 5,926,077 | A | 7/1999 | Milroy | |
| 5,995,055 | A | 11/1999 | Milroy | |
| 6,075,494 | A | 6/2000 | Milroy | |
| 6,101,705 | A * | 8/2000 | Wolfson et al. | 29/600 |
| 6,430,805 | B1 | 8/2002 | Ekmekji et al. | |

* cited by examiner

*Primary Examiner*—Shih-Chao Chen
(74) *Attorney, Agent, or Firm*—Leonard A. Alkov

(57) ABSTRACT

A true-time-delay feed network for a continuous transverse stub antenna array includes a plurality of feed levels, each comprising one or more rails, the feed levels arranged in a spaced configuration. An open parallel plate region is defined between adjacent ones of the feed levels. The rails of the plurality of feed levels are arranged to form a power divider network unencumbered with septums or wall portions protruding into the open region.

50 Claims, 4 Drawing Sheets

TRUE-TIME-DELAY FEED NETWORK FOR CTS ARRAY

This invention was made with Government support under Contract No. F30602-96-C-0283 awarded by the Department of the Air Force. The Government has certain rights in this invention.

BACKGROUND

Continuous transverse stub (CTS) arrays are disclosed, for example, in U.S. Pat. Nos. 5,926,077; 5,995,055; and 6,075,494. CTS arrays can be implemented as true-time-delay (TTDCTS) apertures employing parallel plate feeds. Typically there are a relatively large number of rails of varying shapes that are fabricated and assembled together in order to realize the aperture/parallel plate feed assembly.

Most antenna applications require two directive (high-gain, narrow bandwidth) beams, each at a different frequency band. In communication applications, the two beams perform the transmit and receive functions. Conventional dish antennas can perform these functions, but require relatively large swept volumes, which is not desirable for an installation that is adversely affected by it, such as an aircraft. Conventional phased arrays also can perform these functions, but include a fully populated lattice of discrete phase-shifters or transmit/receive elements each requiring their own phase and/or power-control lines. The recurring (component, assembly, and test) costs, prime-power, and cooling requirements associated with such electronically controlled phased-arrays can be prohibitive in many applications. In addition, such conventional arrays can suffer from degraded ohmic efficiency (peak gain), poor scan efficiency (gain roll-off with scan), limited instantaneous bandwidth (data rates), and data stream discontinuities (signal blanking between commanded scan positions). These cost and performance issues can be particularly pronounced for physically large and/or high-frequency arrays where the overall phase-shifter/transmit-receive module count can exceed many tens of thousands elements. In addition, when the transmit and receive frequency bands are widely spaced, two arrays can be required, one to perform the transmit function and one for the receive function.

SUMMARY OF THE DISCLOSURE

A true-time-delay feed network for a continuous transverse stub antenna array includes a plurality of feed levels, each comprising one or more rails, the feed levels arranged in a spaced, parallel configuration. An open parallel plate region is defined between adjacent ones of the feed levels. The rails of the plurality of feed levels are arranged to form a power divider network unencumbered with septums or wall portions protruding into the open region.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION OF THE DISCLOSURE

Figure 1:
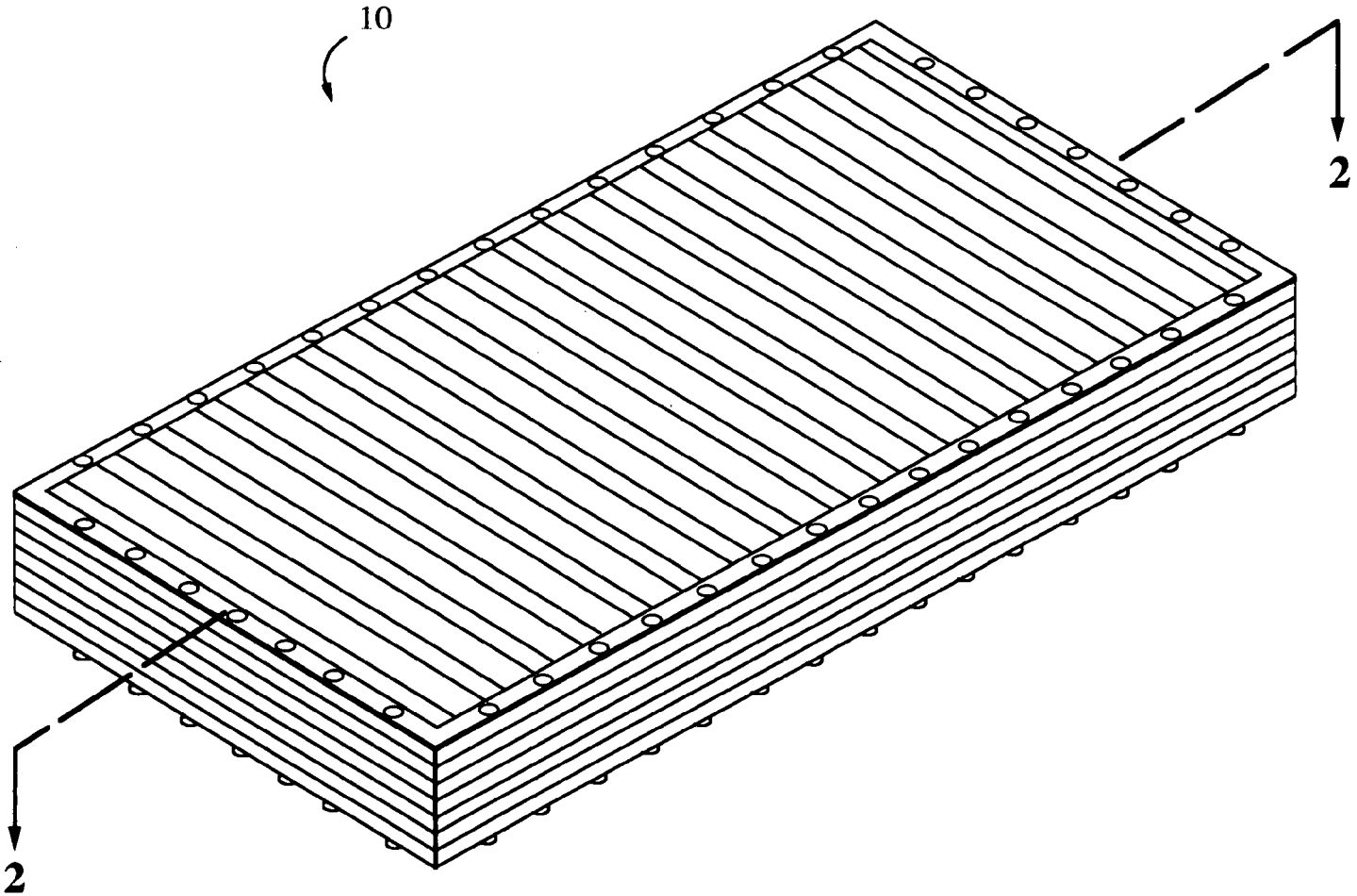
FIG. 1 is an isometric view of an exemplary embodiment of a parallel plate feed and antenna aperture assembly, with a continuous transverse stub (CTS) radiating aperture surface.

In the following detailed description and in the several figures of the drawing, like elements are identified with like reference numerals.

FIGS. 1-5 illustrate an exemplary embodiment of a TTDCTS parallel plate feed and antenna aperture assembly 10 in accordance with the invention. The assembly 10 comprises a plurality of levels of rails, each level held in a spaced relationship with respect to adjacent rails. In contrast with prior approaches, the rails at the various levels of the exemplary embodiment of the assembly need not have physical contact to form the hard shorts used in a corporate feed. Moreover, in this embodiment, features on the rails at any one level of the assembly are identical and periodic, which can reduce tooling and manufacturing cost.

Figure 2:
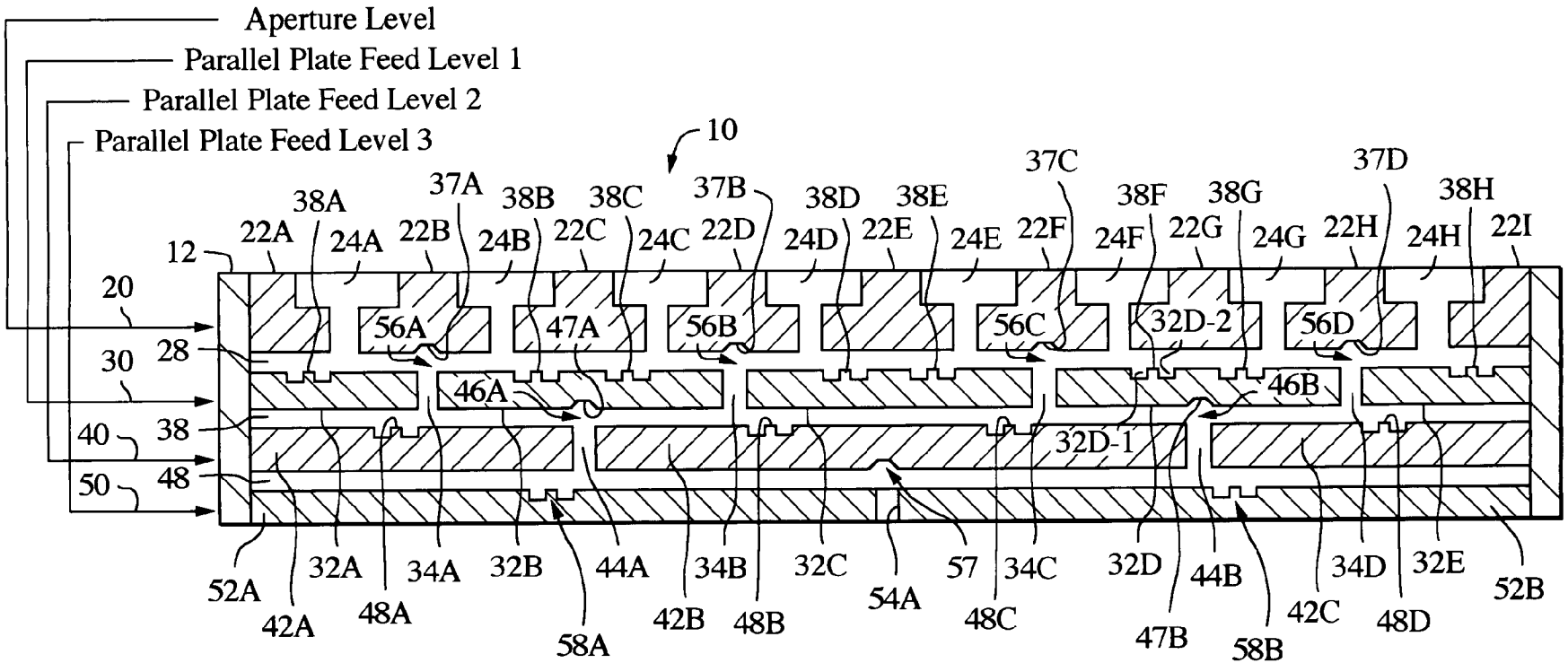
FIG. 2 is a simplified cross-sectional view, taken along line 2-2 of FIG. 1.

The different levels of the assembly 10 are illustrated in the cross-sectional view of FIG. 2. An aperture level 20 comprises a plurality of spaced rails 22A-22I, which define radiating stubs 24A-24H. Interior rails 22B-22H are identical. End or exterior rails 22A and 22I are mirror images of each other, and are truncated versions of the interior rails.

The first parallel plate feed level 30 comprises a plurality of spaced rails 32A-32E, spaced apart such that adjacent edges of the rails define slots 34A-34D. Interior rails 32B-32D are identical. End or exterior rails 32A and 32E are truncated versions of the interior rails. The rails are formed with respective pairs of inductive wells or grooves, e.g. grooves 32D-1, 32D-2 formed in rail 32-D, which are discussed more fully below.

The second parallel plate feed level 40 comprises a plurality of spaced rails 42A-42C, spaced apart such that adjacent edges of the rails define slots 44A, 44B. The end rails 42A, 42C are truncated versions of the interior rail 42B. The rails have pairs of wells formed therein as well.

The third parallel plate feed level 50 comprises two rails 52A, 52B, spaced apart such that adjacent edges of the rails form a slot 54A. Each rail has a pair of wells formed therein as well.

The rails of each level can be fabricated as a single unit, or assembled together to form a single unit, reducing the number of parts. The rails have electrically conductive surfaces, and can be fabricated from a metal, e.g. aluminum, by machining, extrusion, or other processes. Alternatively the rails can be fabricated from a plastic material, e.g. by molding or extrusion, and plated with a conductive layer.

The levels 20, 30, 50 and 50 are assembled together in a spaced relationship, as illustrated in FIG. 2, forming open parallel plate regions 28, 38, 48 between respective adjacent levels. The open regions are unencumbered by hard shorts or bends or protruding septums of power dividers utilized in conventional waveguide or parallel plate feeds.

In a transmit mode, RF energy is launched into the slot 54A, e.g. by a line source, and divides into two components which propagate in opposite directions in the parallel plate region 48, thus forming a 1:2 power divider. Energy propagating in the region 48 enters slots 44A, 44B in level 40, and divides into respective components which propagate in the parallel plate region 38, thus forming two 1:2 power dividers. Now the input energy has been divided into four components. The energy propagating in region 38 enters slots 34A-34D in level 30, separating into respective pairs of energy components which propagate in region 28 adjacent the aperture level 20. The input energy has been divided into eight components in region 28, one component for each transverse stub 24A-24H. The respective energy components radiate from the respective stubs. In this exemplary embodiment, the path lengths from the slot 54A to the respective stubs are equal in length, so that the time delay is equal for each path, and the signal components radiated from each slot will be in phase. Of course, on receive, the received signal components at each stub will be combined in phase to provide a single combined signal component at slot 54A.

Figure 3:
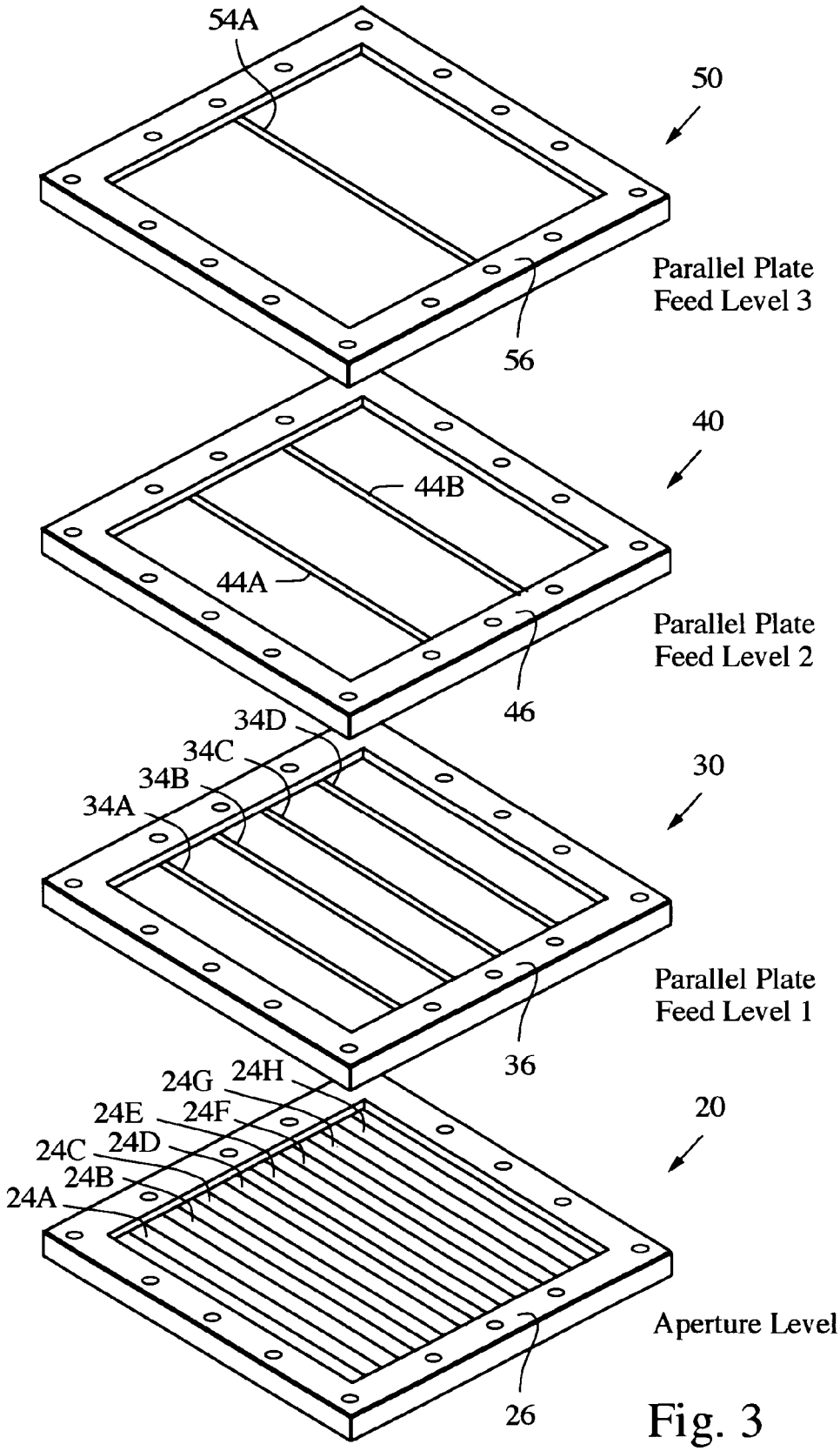
FIG. 3 is an exploded view of levels of the parallel plate feed and antenna aperture assembly of FIGS. 1-2.
Figure 4:
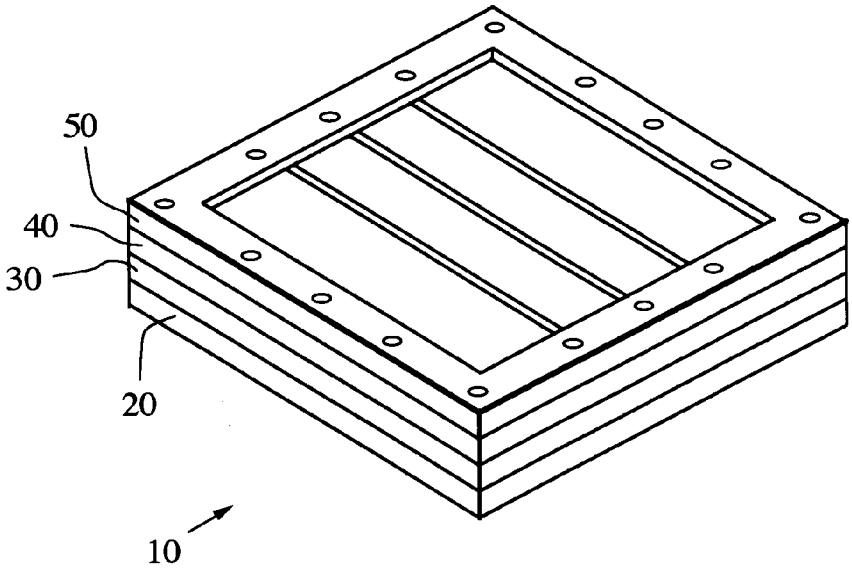
FIG. 4 is a bottom isometric view of the assembly of FIGS. 1-3, showing a feed surface.

FIG. 3 is an exploded view of an exemplary embodiment of a TTDCTS aperture parallel plate assembly, showing the levels 20, 30, 40, 50, which when stacked in spaced relation form the assembly 10 of FIG. 4. Each level includes a peripheral frame to hold the respective rails of that level in place as a single unit. Thus, frame 56 holds the rail 52A of level 50, frame 46 holds the rails 42A-42C of level 40, frame 36 holds the rails 32A-32E of level 30, and frame 26 holds the rails 22A-22I of the aperture level 20. The individual rails can be assembled to the frame using various techniques, including fasteners, brazing, welding, adhesives or even by a pressure fit into mounting areas of the frame. The frames can have a thickness which provides the desired spacing between adjacent levels when the frames are stacked together. FIG. 4 is an isometric view showing the assembly 10 with the levels stacked together.

The assembly 10 makes use of "virtual" shorts that replace a perfect electrical conductor ("PEC") short wall in the path of propagating waves inside the parallel-plate or rectangular waveguide structures, typically arranged at a 45 degree angle to direct energy from a parallel plate region into a slot communicating with a next level. The virtual short is matched by inductive wells or grooves formed in the parallel plate structure where the propagating wave is confined. The depth, width and the number of wells replacing the PEC short wall are dependent on bandwidth and the separation distance between the walls.

The assembly 10 also makes use of septum-less TEE E-plane power dividers, that do not employ protruding septums in front of the input arm of the TEE. Instead, the protruding septum and its function (matching) can replaced by one or more inductive wells or grooves, e.g. a pair of wells formed in the two co-linear arms of the TEE, if desirable for a particular application. The dimensions of the wells and their distances to the input arm determine the bandwidth and matching properties of the tee.

Figure 5:
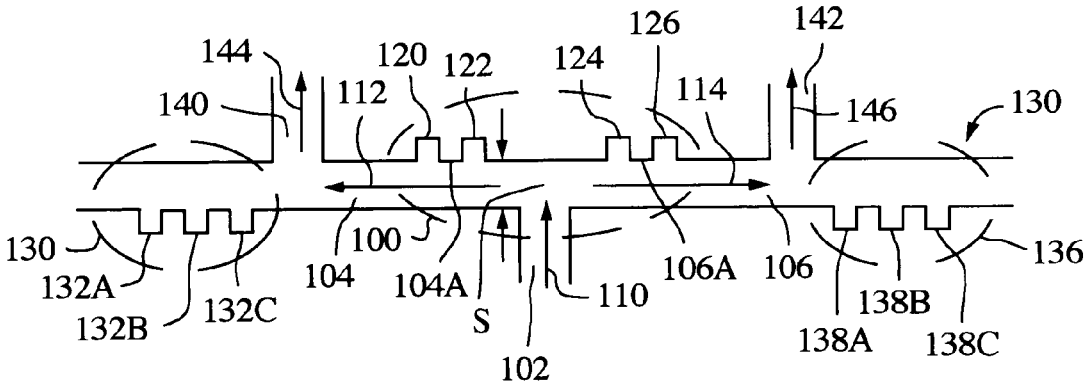
FIG. 5 is an exemplary virtual E-bend/Tee schematic diagram.

FIG. 5 is a simplified schematic illustrating a septum-less E-plane TEE power divider and virtual short. Input RF energy indicated by arrow 110 enters the TEE power divider 100 through an input arm 102, and is divided between the two co-linear side arms 104, 106. The divided energy components are indicated by arrows 112, 114. To provide matching functions, pairs of inductive wells are formed in the parallel-plate structure opposite the input arm 102. Thus, a pair of wells 120, 122 are formed in the wall 104A of side arm 104, and a pair of wells 124, 126 are formed in the wall 106A of side arm 106. The spacing of the pairs of wells from the input arm, and the well dimensions, are selected for a given implementation in dependence on bandwidth and the matching properties for that application. It is noted that there is no protruding septum structure into the space S at the TEE junction. For the three-port, TEE structures, the incorporation of depth and width adjusted wells or troughs in the co-linear side arms creates matching susceptances for the remaining ports of the same TEE structure. In addition, maintaining an integral half-wavelength spacing between the wells and input arm provides dual-band frequency capability. For example, a centerline between wells 120, 122 is spaced a distance from the center of the input arm 102 approximately equal to an integral multiple of one half wavelength at a center frequency of each operating band. An exemplary dual band embodiment supports operation at a first band centered at 20.7 Ghz, and at a second band centered at 44.5 Ghz, by way of example, i.e. where the center frequency of the second band is approximately double that of the first band.

In some applications, the septum-less TEE power divider as employed in the feed network of the TTDCTS array may not employ matching wells formed in each side arm port. The exemplary embodiment of FIG. 2, for example is illustrated without side arm matching wells for the septum-less TEE power dividers. In this embodiment, a tuning well is positioned at a wall opposite the input port, e.g. well 57.

A virtual short 130 is also illustrated in FIG. 5. In this example, the energy in side arm channel 104 is to be directed into channel 140, as indicated by arrow 144. Similarly, the energy in side arm channel 106 is to be diverted into channel 142, as indicated by arrow 146. Conventionally, a PEC wall at a 45 degree angle would be employed as a short in the side arm channel to divert energy into channel 142. Instead, a "virtual" short is employed. For example, circuit 130 is a matching network for one virtual short, and comprises a plurality of spaced inductive wells or grooves 132A-132C formed in a wall of the side arm channel 104. Circuit 136 is a matching network for a second virtual short to divert energy into channel 142, and comprises a plurality of spaced inductive wells or grooves 138A-138C formed in a wall of the side arm channel 106. For parallel plate termination, the matching network for the virtual short introduces a very high susceptance that eliminates the need for a physical short, i.e. an electrically conductive wall. The number of wells and the well depth and width are parameters which can be varied to optimize the matching for the virtual shorts, taking into account all of the feed levels at once.

Referring again to FIG. 2, it can be seen that septum-less TEE power dividers and virtual shorts are employed in the assembly 10. Consider RF energy entering the assembly through port 54A. This input energy is divided by a septum-less TEE 56 defined by facing surfaces of the rails 52A, 52B and 42A-42C and open channel 48, and is directed in opposite directions within open channel 48, to be directed into open slots 44A, 44B in the second level 40. Virtual shorts 58A, 58B comprising inductive wells are formed in the top surfaces of the rails. RF energy does not propagate along space 48 past the virtual shorts 58A-58B.

Slots 44A, 44B comprise input arms for septum-less TEE power dividers 46A, 46B, to divide the RF energy entering these power dividers into RF energy components conducted into open channel 38. The energy components from divider 46A enter slots 34A, 34B in feed level 30, and the energy components from divider 46B enter slots 34C, 34D in feed level 30.

A third level of power dividers 56A, 56B, 56C, 56D in turn divides the power from the second level of dividers 46A, 46B into eight RF energy components which are directed into the radiating stubs 24A-24H.

Each of these power dividers of the first, second and third levels of power dividers in this embodiment are septum-less power dividers, i.e. without a septum element protruding into the open channel between levels. These power dividers further include tuning wells formed on the wall opposite the input arm or channel to improve impedance matching. Thus, TEE divider 56 includes a well 57. TEEs 46A, 46B respectively include wells 47A, 47B. TEEs 56A-56D include wells 57A-57D, respectively. Virtual shorts are employed instead of hard shorts extending into the open channels. Thus, for open channel 48, virtual shorts 58A, 58B each comprising a pair of inductive wells formed in the surface of respective rails 52A, 52B, prevent energy entering from input port 57A from passing beyond the shorts. For open channel 38, virtual shorts 48A, 48B are positioned for TEE 46A, and virtual shorts 48C, 48D are positioned for TEE 46B. For open channel 28, virtual shorts 38A, 38B are positioned for TEE 56A, virtual shorts 38C, 38D are positioned for TEE 56B, virtual shorts 38E, 38F are positioned for TEE 56C, and virtual shorts 38G, 38H are positioned for TEE 56D.

It is to be understood that the antenna aperture and parallel plate feed assembly described above is capable of reciprocal operation, i.e. for operation on receive as well as transmit. Thus, while slot 54A is described above in terms of an input port for the assembly, the slot functions as an output port when the assembly is operated on receive.

Although the foregoing has been a description and illustration of specific embodiments of the invention, various modifications and changes thereto can be made by persons skilled in the art without departing from the scope and spirit of the invention as defined by the following claims.

What is claimed is:

1. A true-time-delay feed network for a continuous transverse stub antenna array, comprising:

a plurality of feed levels, each comprising one or more rails, the feed levels arranged in a spaced configuration;

an open parallel plate region between adjacent ones of the feed levels; and the rails of the plurality of feed levels arranged to form with said open region a power divider network unencumbered with septums or shorting wall portions protruding into the open region, wherein the rails of each level are not in direct physical contact with rails of any other level.

2. The feed network of claim 1, wherein each feed level is assembled as a single unit.

3. The feed network of claim 1 wherein the power divider network is fabricated as a network of septumless TEE power dividers.

4. The feed network of claim 3, wherein each of said levels includes at least one slot formed by said one or more rails of said level, and each TEE power divider includes an input arm provided by a slot of one or more slots, and first and second co-linear side arms in said open region.

5. The feed network of claim 4, wherein each said TEE power divider includes inductive wells for each side arm formed in a wall defined by one of said rails opposite said input arm.

6. The feed network of claim 5, wherein said inductive wells are spaced from said input arm by a distance which is an integral multiple of one half wavelength at a frequency in an operating frequency band.

7. The feed network of claim 6, wherein the feed network is configured for dual frequency band operation, and wherein said distance is an integral multiple of one half wavelength at a frequency in said operating frequency band and at a frequency in another operating band.

8. The feed network of claim 1, wherein the feed network comprises a plurality of virtual shorts.

9. The feed network of claim 8, comprising for each virtual short an inductive well formed in a rail.

10. The feed network of claim 8, wherein each virtual short is matched by a plurality of inductive wells formed in a surface of said rail.

11. The feed network of claim 1, wherein each of said feed levels defines at least one slot in said one or more rails.

12. The feed network of claim 1, further comprising, for each level, a peripheral frame to hold the one or more rails of that level in place as a single unit.

13. The feed network of claim 1, wherein said feed levels are substantially parallel feed levels.

14. A true-time-delay continuous transverse stub (TTDCTS) parallel plate feed and antenna aperture assembly, comprising:

a plurality of levels of rails, each level held in a spaced relationship with respect to adjacent rails, wherein the rails of each level are not in direct physical contract with rails of any other level, said plurality of levels of rails comprising:

an aperture level comprising a plurality of spaced rails defining an array of radiating stubs; and a plurality of feed levels, each comprising one or more rails, the feed levels arranged in a spaced configuration to define an open parallel plate region between adjacent ones of the feed levels, the rails of the plurality of substantially planar feed levels arranged to form a power divider network unencumbered with septums or shorting wall portions protruding into the open region.

15. The assembly of claim 13, wherein said plurality of substantially planar feed levels includes:

a first parallel plate feed level spaced from the aperture level and comprising a plurality of rails spaced apart such that adjacent edges of the rails define a plurality of slots;

a second parallel plate feed level spaced from the first parallel plate feed level and comprising a plurality of rails spaced apart such that adjacent edges of the rails define a slot.

16. The feed network of claim 13, wherein each feed level is assembled as a single unit.

17. The feed network of claim 14 wherein the power divider network is fabricated as a network of septumless TEE power dividers, each comprising an input arm and a pair of co-linear side arms.

18. The feed network of claim 17, wherein each of said levels includes at least one slot farmed by said one or more rails of said level, and each TEE power divider includes an input arm provided by a slot of one or more slots, and first and second co-linear side arms in said open region.

19. The feed network of claim 18, wherein each said TEE power divider includes inductive wells for each side arm formed in a wall defined by a rail opposite said input arm.

20. The feed network of claim 19, wherein said inductive wells are spaced from said input arm by a distance which is an integral multiple of one half wavelength at a frequency in an operating frequency band.

21. The feed network of claim 20, wherein the feed network is configured for dual frequency band operation, and wherein said distance is an integral multiple of one half wavelength at a frequency in said operating frequency band and at a frequency in another operating band.

22. The feed network of claim 14, wherein the feed network comprises a plurality of virtual shorts, one for each side arm of TEE networks.

23. The feed network of claim 22, wherein each virtual short is matched by at least one inductive well formed in a rail.

24. The feed network of claim 22, wherein each virtual short is matched by a plurality of inductive wells formed in a surface of said rail.

25. The feed network of claim 14 wherein said plurality of feed levels and said aperture level are substantially parallel planar levels.

26. A dual band, true-time-delay continuous transverse stub (TTDCTS) parallel plate feed and antenna aperture assembly, comprising:

a plurality of levels of rails, each level held in a spaced relationship with respect to adjacent rails, wherein the rails of each level are not in direct contact with rails of any other level, said plurality of levels of rails comprising:

an aperture level comprising a plurality of spaced rails defining an array of radiating stubs; and a plurality of feed levels, each comprising one or more rails, the feed levels arranged in a spaced configuration to define open parallel plate regions between adjacent ones of the feed levels and between said aperture level and an adjacent feed level, the rails of the plurality of substantially planar feed levels arranged to form a power divider network for feeding said array of radiating stubs with RF energy launched into an input port of said plurality of feed levels, said power divider network unencumbered with septums or shorting wall portions protruding into the open region, said power divider network configured for operation in a first frequency band and a second frequency band.

27. The assembly of claim 26, wherein said plurality of feed levels includes:

a first parallel plate feed level spaced from the aperture level and comprising a plurality of rails spaced apart such that adjacent edges of the rails define a plurality of slots;

a second parallel plate feed level spaced from the first parallel plate feed level and comprising a plurality of rails spaced apart such that adjacent edges of the rails define a slot which functions as said input port.

28. The feed network of claim 26 wherein the power divider network is fabricated as a network of septumless TEE power dividers, each comprising an input arm and a pair of co-linear side arms.

29. The feed network of claim 28, wherein each of said levels includes at least one slot formed by said one or more rails of said level, and each TEE power divider includes an input arm provided by a slot of one or more slots, and first and second co-linear side arms in said open region.

30. The feed network of claim 29, wherein each said TEE power divider includes inductive wells for each side arm formed in a wall defined by a rail opposite said input arm.

31. The feed network of claim 30, wherein said inductive wells are spaced from said input arm by a distance which is an integral multiple of one half wavelength at a frequency in each of said first frequency band and said second frequency band.

32. The feed network of claim 26, wherein the feed network comprises a plurality of virtual shorts.

33. A true-time-delay feed network for a continuous transverse stub antenna array, comprising:

a plurality of feed levels, each comprising one or more rails, the feed levels arranged in a spaced configuration;

an open parallel plate region between adjacent ones of the feed levels; and the rails of the plurality of feed levels arranged to form with said open region a power divider network unencumbered with septums or shorting wall portions protruding into the open region, wherein the feed network comprises a plurality of virtual shorts.

34. The feed network of claim 33, wherein each feed level is assembled as a single unit.

35. The feed network of claim 33, wherein the power divider network is fabricated as a network of septumless TEE power dividers.

36. The feed network of claim 35 wherein each of said levels includes at least one slot formed by said one or more rails of said level, and each TEE power divider includes an input arm provided by a slot of said one or more slots and first and second co-linear side arms in said open region.

37. The feed network of claim 36, wherein each said TEE power divider includes inductive wells for each side arm formed in a wall defined by one of said rails opposite said input arm.

38. The feed network of claim 37, wherein said inductive wells are spaced from said input arm by a distance which is an integral multiple of one half wavelength at a frequency in art operating frequency band.

39. The feed network of claim 38, wherein said feed network is configured for dual frequency band operation, and wherein said distance is an integral multiple of one half wavelength at a frequency in said operating frequency band and at a frequency in another operating band.

40. The feed network of claim 33, comprising for each virtual short an inductive well formed in a rail.

41. The feed network of claim 33, wherein each virtual short is matched by a plurality of inductive wells fanned in a surface of said rail.

42. The feed network of claim 33, wherein each of said feed levels defines at least one slot in said one or more rails.

43. The feed network of claim 33, further comprising, for each level, a peripheral frame to hold the one or more rails of that level in place as a single unit.

44. The feed network of claim 33, wherein said feed levels are substantially parallel feed levels.

45. A dual band, true-time-delay continuous transverse stub (TTDCTS) parallel plate feed and antenna aperture assembly, comprising:

a plurality of levels of rails, each level held in a spaced relationship with respect to adjacent rails, said plurality of levels of rails comprising:

an aperture level comprising a plurality of spaced rails defining an array of radiating stubs; and a plurality of feed levels, each comprising one or more rails, the feed levels arranged in a spaced configuration to define open parallel plate regions between adjacent ones of the feed levels and between said aperture level and an adjacent feed level, the rails of the plurality of substantially planar feed levels arranged to form a power divider network for feeding said array of radiating stubs with RF energy launched into an input port of said plurality of feed levels, said power divider network unencumbered with septums or shorting wall portions protruding into the open region, said power divider network configured for operation in a first frequency band and a second frequency band, wherein the reed network comprises a plurality of virtual shorts.

46. The assembly of claim 45, wherein said plurality of feed levels includes:

a first parallel plate feed level spaced from the aperture level and comprising a plurality of rails spaced apart such that adjacent edges of the rails define a plurality of slots;

a second parallel plate feed level spaced form the first parallel plate feed level and comprising a plurality of rails spaced apart such that adjacent edges of the rails define a slot which functions as said input port.

47. The feed network of claim 45, wherein the power divider network is fabricated as a network of septumless TEE power dividers, each comprising an input arm and a pair of co-linear side arms.

48. The feed network of claim 47, wherein each of said levels includes at least one slot formed by said one or more rails of said level, and each TEE power divider includes an input arm provided by a slot of said one or more slots, and first and second co-linear side arms in said open region.

49. The feed network of claim 48, wherein each said TEE power divider includes inductive wells for each side arm formed in a wall defined by a rail opposite said input arm.

50. The feed network of claim 49, wherein said inductive wells are spaced from said input arm by a distance which is an integral multiple of one half wavelength at a frequency in each of said first frequency band and said second frequency band.

* * * * *